US006431812B1

(12) United States Patent
Budny

(10) Patent No.: US 6,431,812 B1
(45) Date of Patent: Aug. 13, 2002

(54) APPARATUS FOR REMOVING ROD-SHAPED ARTICLES OF THE TOBACCO PROCESSING INDUSTRY FROM RECEPTACLES

(75) Inventor: Piotr Budny, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/510,193

(22) Filed: Feb. 22, 2000

(30) Foreign Application Priority Data

Feb. 20, 1999 (DE) ..... 199 07 327

(51) Int. Cl.[7] ..... B65B 19/02

(52) U.S. Cl. ..... 414/404; 414/421; 414/403; 414/414; 131/282; 221/188

(58) Field of Search ..... 414/403, 421, 414/404, 422, 419, 420, 414, 418; 221/188, 189, 224, 288; 131/282, 283; 294/115, 116

(56) References Cited

U.S. PATENT DOCUMENTS 3,655,080 A * 4/1972 Gianese ..... 414/403 X
4,278,385 A 7/1981 Bardenhagen et al.
4,455,117 A * 6/1984 Cartoceti ..... 414/421 X
4,564,329 A * 1/1986 Bantien ..... 414/403

FOREIGN PATENT DOCUMENTS

FR 735 504 11/1932
FR 1 532 925 6/1968

* cited by examiner

*Primary Examiner*—Frank E. Werner
(74) *Attorney, Agent, or Firm*—Venable; Robert Kinberg

(57) ABSTRACT

A device used in the tobacco-processing industry for emptying a container filled with rod-shaped articles into a magazine, in which the container has an open upper narrow side and an open wide front side. The device includes a container holder that accommodates the container and which can be tilted by 180° so that the container assumes an emptying position above the magazine. The container holder includes an article support comprising two support strips mounted for being adjacent and movable relative to the open narrow side of the container. An actuation mechanism is connected to the article support for effecting an opening movement in which the two support strips undergo a vertical drop movement and a horizontal spreading movement in which the two movable strips move in opposite directions to respective sides of the container to allow the articles to be released from the container.

6 Claims, 4 Drawing Sheets

APPARATUS FOR REMOVING ROD-SHAPED ARTICLES OF THE TOBACCO PROCESSING INDUSTRY FROM RECEPTACLES

CROSS-REFERENCE TO RELATED APPLICATIONS

Priority is claimed with respect to application No. 199 07 327.9 filed in Germany on Feb. 20, 1999, the disclosure of which is incorporated herein by reference.

BACKGROUND OF THE INVENTION

The invention relates to a device used in the tobacco-processing industry for emptying containers filled with rod-shaped articles into a magazine, the device comprising at least one container holder for accommodating a container that is open on the upper narrow side and the wide frontal side and can be tilted by 180° into an emptying position above the magazine. The container holder has an article support that can be moved relative to the narrow open side of the container.

After leaving the production machines, rod-shaped articles such as cigarettes, filter cigarettes or filter rods are frequently stored temporarily, in a parallel alignment inside containers, having the form of so-called racks with a depth of approximately one cigarette length, which are open on the top and front. The filled racks are then tilted upside down by the container holder, which can be pivoted by 180°, and emptied into a magazine serving as a storage container for a processing machine. In the process, the articles drop due to their inherent weight, in a free fall, onto the level of the articles already stored in the storage container. Efforts are made to keep the falling distance as short as possible to ensure a continued parallel alignment and prevent the articles from falling in a disorderly fashion into the rack during the emptying operation, thus causing production interruptions in the processing machine.

One essential circumstance that effects the more or less orderly discharge of the articles is the manner in which the discharge opening on the rack is released by the blade-type support strips of the container holder.

With a closing system, normally used in practical operations, the support strips are designed as tilting blades, which are tilted downward by about 90° during the sudden opening, so that their support surface, which extends in horizontal direction in the closed position, assumes a vertical position that effects the drop height.

Another generally used closing system consists of a flat pull blade, the linear opening movement of which causes friction on the articles.

SUMMARY OF THE INVENTION

It is an object of the invention to create a closing system for which the opening dynamic ensures a controlled transfer of the articles into a magazine at a minimum drop height.

The above and other objects are accomplished according to the invention by the provision of a device used in the tobacco-processing industry for emptying a container filled with rod-shaped articles into a magazine, the container having an open upper narrow side and an open wide front side, the device comprising: a container holder that accommodates the container and which can be tilted by 180° so that the container assumes an emptying position above the magazine, the container holder including: an article support comprising two support strips mounted for being adjacent and movable relative to the open narrow side of the container; and actuation means connected to the article support for effecting an opening movement in which the two support strips undergo a vertical drop movement and a horizontal spreading movement in which the two movable strips move in opposite directions to respective sides of the container to allow the articles to be released from the container.

Thus, in accordance with the invention, the article support, which consists of two support strips that can be moved in opposite directions, is provided with actuation means that effect an opening movement, composed of a vertical drop movement and an essentially horizontal spreading movement to the side, resulting in an outward expanding movement.

A jerk-free or flowing transfer movement is achieved by designing the actuating means such that they act upon the article support by performing initially a mostly vertical drop movement, which is subsequently superimposed by a primarily spreading movement.

A separation of individual articles from the underside of the container filling is prevented so that a compact block-type lowering of the container content is ensured, in that the actuation means of the article support are designed to be accelerated less at the start of the vertical drop and to be accelerated more toward the end of the vertical drop where there is a transition to the primarily horizontal, spreading movement.

According to a modification of the invention, the aforementioned movement sequence or superimposition of movements can be achieved with relatively little expenditure in that the actuation means comprise a radial cam drive, which acts upon the article support, as well as control rods that can pivot around locally fixed shaft and act upon the pivoting levers of the article support, which carry the support strips.

With a simple, operationally safe embodiment of the actuation means, the radial cam drive comprises a cam disk that is driven such that it rotates around a locally fixed shaft and a cam roller that is positioned on a traverse, can be moved along a linear guide, and supports the pivoting levers.

According to another suggestion, an opening force that requires little expenditure is achieved in that tension springs act upon the pivoting levers and pre-stress the support strips in spreading direction.

In order to prevent a subsequent elastic bouncing back of the support strips to their opened position, it is furthermore suggested that the pivoting levers are connected with a hinge to the blocking levers that extend straight toward each other in the spread position, the joint central connecting hinge of which is connected to a traveling carriage guided inside a movable slide of the linear guide.

According to one advantageous embodiment, favorable spatial movement conditions of the vertical drop movement and the horizontal spreading movement result from the fact that the pivoting levers carrying the support strips extend considerably past the height of a container and are provided with contact points for the cam roller, connecting rod levers, tension springs and blocking levers, which succeed each other from top to bottom in the emptying position.

The advantage achieved with the invention is that the block formation of the container content is retained in the opening phase of the closing system and that no articles will separate out vertically or move away horizontally from the controlled dropping block, so that an uninterrupted operation of the machines for processing the articles further is ensured over the long term.

BRIEF DESCRIPTION OF THE DRAWINGS

The invention is explained in further detail in the following with the aid of the exemplary embodiment shown in the drawing.

DETAILED DESCRIPTION OF THE INVENTION

Figure 1:
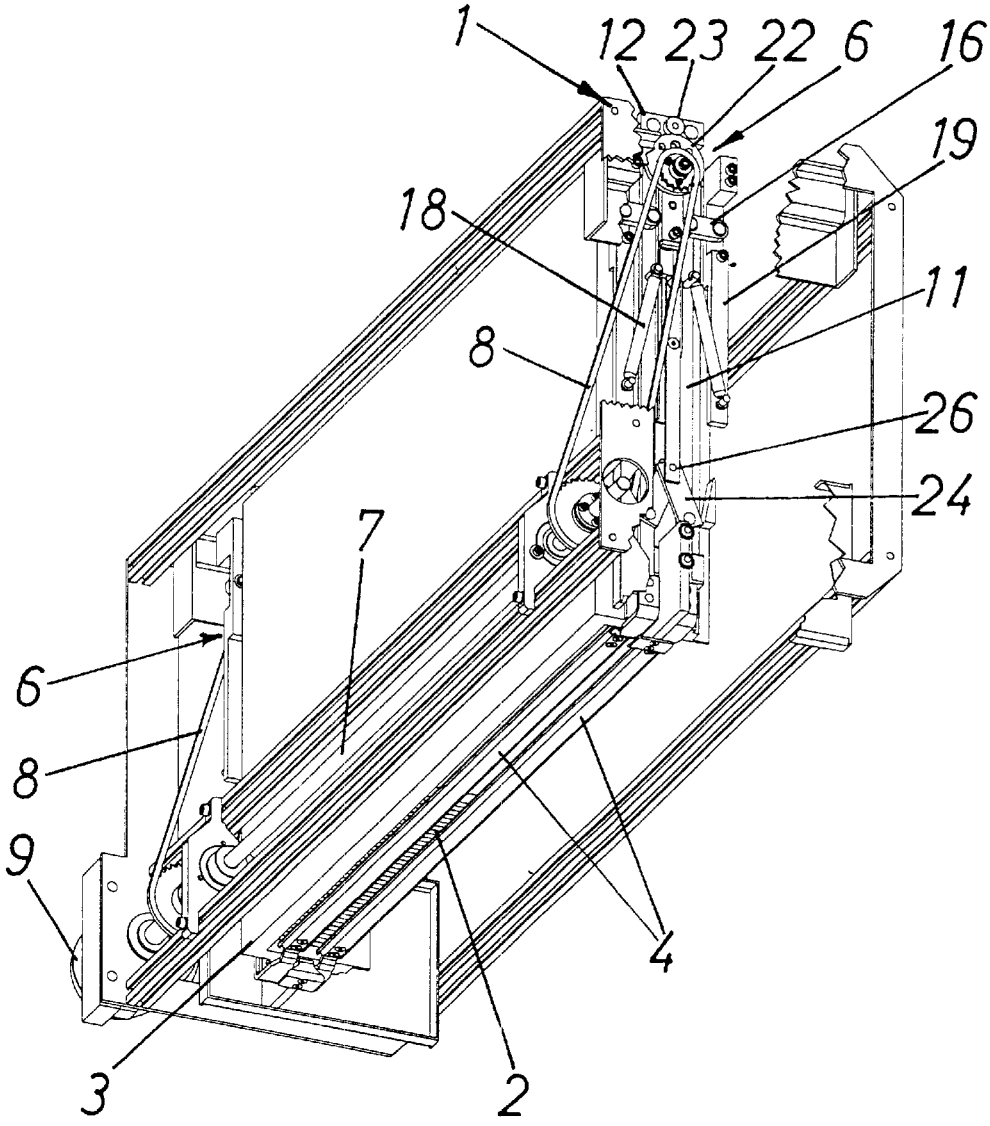
FIG. 1 is a three-dimensional representation of a container holder, which accommodates a rack containing filter cigarettes.

Referring to FIG. 1, there is shown a container holder 1 which represents a part of a rotating double unit (not shown in further detail here) comprising two container holders for a so-called rack-emptying device that rotate around a joint axle, e.g. as known from the U.S. Pat. No. 4,278,385, the subject matter of which is incorporated herein by reference.

Container holder 1, which according to FIG. 1 accommodates a container in the form of a rack 3 filled with filter cigarettes 2, is shown in the emptying position with the open, narrow side of rack 3 pointing downward, wherein the filter cigarettes 2 are still held inside rack 3 with the aid of two closed support strips 4 of container holder 1.

Figure 2:
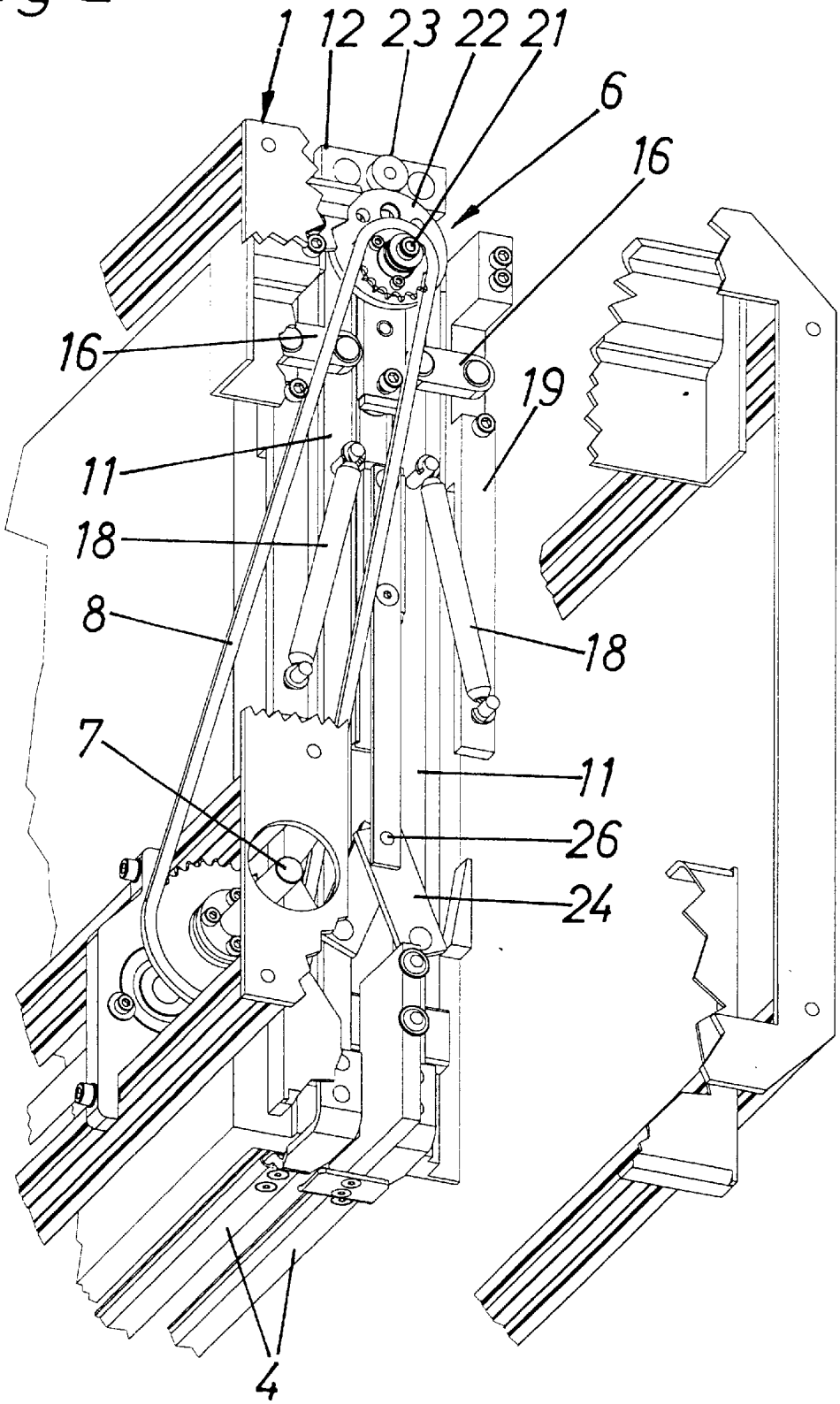
FIG. 2 is a sectional, enlarged representation of drive means and actuating means for activating the closing system of the container holder.

In order to open and close support strips 4, actuation means 6 are provided on two opposing, external sides of container holder 1. Referring additionally to FIG. 2, actuation means 6 can be operated via a spacer shaft 7, and by means of a toothed belt 8, by a joint pneumatic pivot drive 9 that is not shown in further detail here. A pivot drive suitable for performing this function is commercially available from the German company FESTO PNEUMATIK under the type designation DSR 32-180-P.

Actuation means 6 are arranged on both sides of container holder 1 and comprise two pivoting levers 11 that extend approximately past the height of rack 3, on which the support strips 4 are fastened. Pivoting levers 11 are connected with a hinge to a traverse 12, which is a component of a slide 14 (see FIGS. 3 and 4) that can be moved up and down along a linear guide 13. In addition, control rods 16 that can pivot around locally fixed bearings 17 are hinged to and effect the pivoting levers 11 below the traverse 12.

Below the points of contact for the control rods 16, pre-stressed tension springs 18 act upon pivoting levers 11. These springs are attached at their other ends to a rigid frame 19 of container holder 1.

A radial cam drive that acts upon the pivoting levers 11 of the actuation means 6 has a cam disk 22, which rotates eccentrically around a locally fixed shaft 21 and is driven by toothed belt 8, as well as a cam roller 23 that makes contact with cam disk 22 and is positioned on traverse 12.

The lower ends of pivoting levers 11 are connected with a pivoting hinge to blocking levers 24, which are operatively connected via a joint, central connecting hinge 26 to a traveling carriage 27 that is guided by means of roller guides 28 in a slide 14 of linear guide 13.

Figure 3:
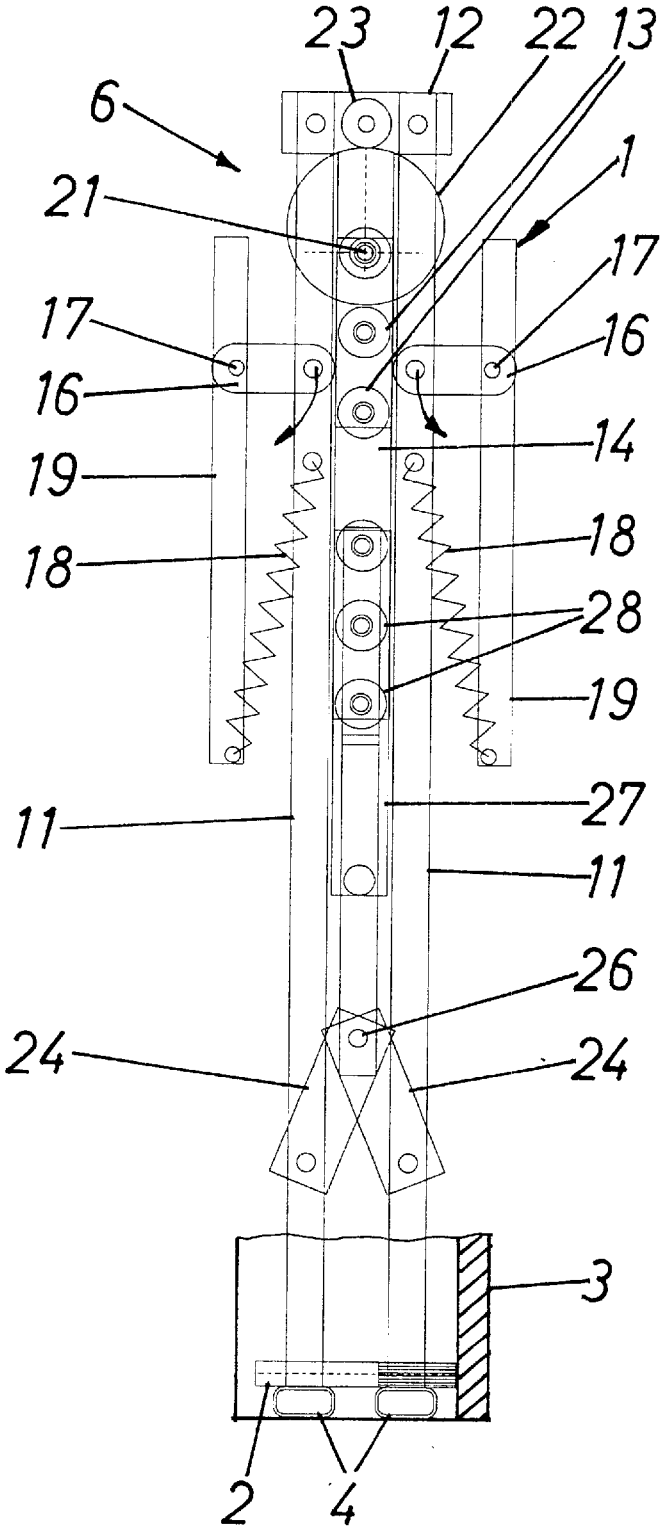
FIG. 3 shows the actuating means of the closing system in the closed position.

The device for emptying operates as follows:

Once the container holder 1 that holds the rack 3 has been tilted upside down to assume the emptying position, shown in FIGS. 1 to 4, in which the filter cigarettes 2 rest on support strips 4 of the closing system as shown in FIG. 3, the pivot drive 9 will put the cam disk 22 on both sides of container holder 1 into a rotating motion. As a result of the curved course of cam disk 22, the traverse 12 with hinged-on pivoting levers 11, supported by the pre-stressed tension springs 18, initially moves at relatively low speed downward in a primarily vertical movement. In this way, the complete block of cigarettes resting on support strips 4 is lowered, wherein the support strips 4 are moved out of rack 3 or are detached from its walls.

Owing to the eccentric course of the curve of cam disk 22, the movement of the traverse 12 with pivoting levers 11 is subsequently accelerated. Thus, the vertical drop caused by the downward and sideways turning control rods 16 changes to a primarily horizontal spreading or outward expanding movement according to FIG. 4, thus causing a more or less abrupt interruption of the contact between support strips 4 and the filter cigarettes 2. The cigarettes are released in a controlled movement into the magazine 29 underneath while simultaneously maintaining the compact block formation.

Figure 4:
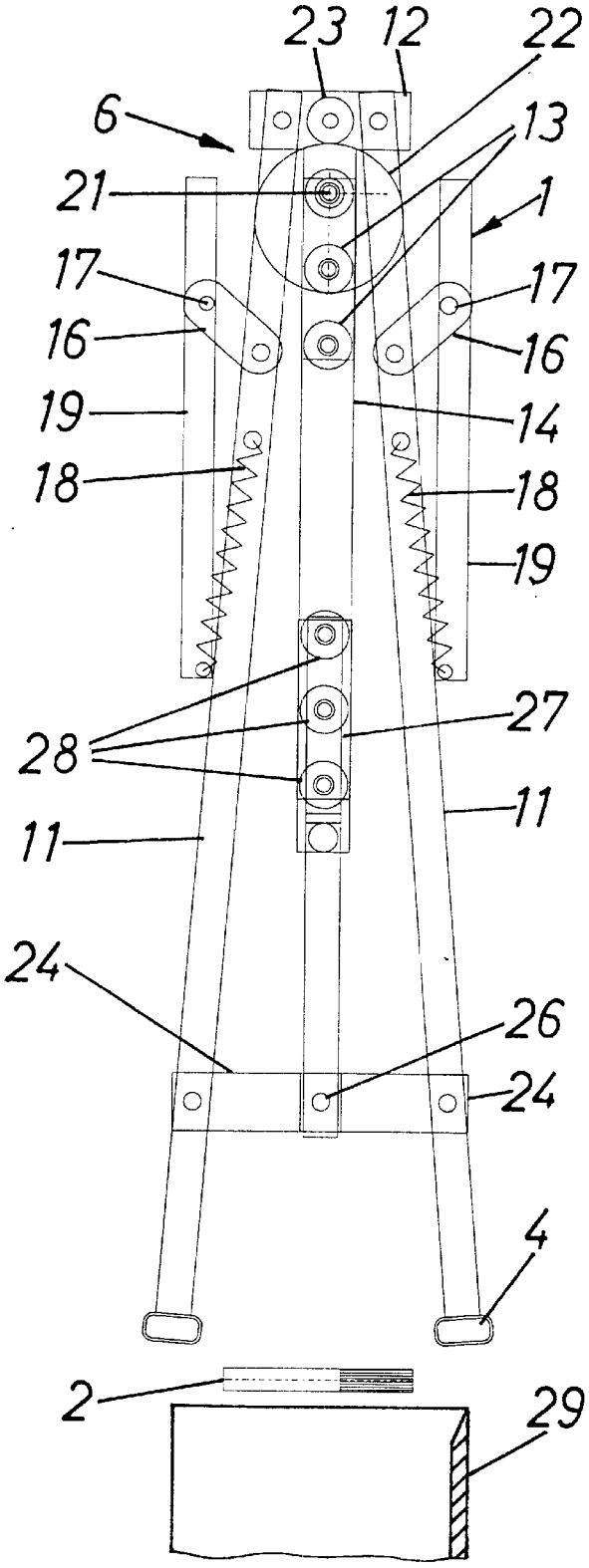
FIG. 4 shows the actuating means of the closing system in the opened position.

According to FIG. 4, this movement sequence of pivoting levers 11 simultaneously forces the blocking levers 24 into a straight blocking position through a relative displacement of its traveling carriage 27 in the slide 14, which prevents a bouncing back of the pivoting levers 11 that would interfere with the transfer operation.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit and scope of the invention.

What is claimed is:

1. A device used in the tobacco-processing industry for emptying a container filled with rod-shaped articles into a magazine, the container having at least one open side, the device comprising:

a container holder that accommodates the container and being adapted to be tilted by 180° relative to an initial position into an emptying position above the magazine;

means for tilting the container holder into the emptying position, the container holder including:

an article support comprising two support strips for supporting the articles adjacent the at least one open side of the container in the emptying position and being movable relative to the at least one open side of the container; and actuation means for effecting an opening movement of the two support strips in which the two support strips undergo an initial vertical movement and a subsequent horizontal spreading movement in which the two support strips move in opposite directions to respective sides of the at least one open side of the container to allow the articles to be released from the container, wherein the actuation means effects the movement of the support strips such that the support strips undergo relatively less acceleration at an initial portion of the vertical movement and relatively more acceleration at a final portion of the vertical movement and at a transition into the subsequent horizontal spreading movement.

2. A device according to claim 1, wherein the actuation means comprises:

pivoting levers connected to and supporting the two support strips;

pivoting control rods, each being pivotable around a respective locally fixed bearing and arranged for acting on the pivoting levers; and a radial cam drive operatively arranged for acting upon the pivoting levers for effecting the opening movement of the support strips.

3. A device according to claim 2, wherein the actuation means further includes a linear guide and a transverse element for carrying the pivoting levers and arranged to be displaced along the linear guide; and wherein the radial cam drive comprises a cam disk which is adapted to be rotatably driven around a locally fixed shaft, and a cam roller positioned on the traverse element and cooperating with the cam disk for displacing the transverse along the linear guide.

4. A device according to claim 3, wherein the actuation means further comprises tension springs that act upon the pivoting levers to pre-stress the two support strips in a spreading direction.

5. A device according to claim 4, wherein the linear guide includes a displaceable slide and a traveling carriage guided inside the displaceable slide, the actuation means further including blocking levers and hinges connecting the pivoting levers to the blocking levers which extend straight toward each other in a spread position, wherein a central one of the connecting hinges is connected to the traveling carriage for displacing the traveling carriage inside the displaceable slide.

6. A device according to claim 4, wherein the pivoting levers extend beyond a height of the container and include successive contact points for the transverse, control rods, tension springs and blocking levers, the contact points extending from top to bottom in the emptying position of the device.

* * * * *